US007823567B2

(12) United States Patent
Drouillard

(10) Patent No.: US 7,823,567 B2
(45) Date of Patent: Nov. 2, 2010

(54) FUEL PUMP FOR INTERNAL COMBUSTION ENGINE

(75) Inventor: Darrell Charles Drouillard, Tecumseh (CA)

(73) Assignee: Ford Global Technologies, Dearborn, MI (US)

( * ) Notice: Subject to any disclaimer, the term of this patent is extended or adjusted under 35 U.S.C. 154(b) by 83 days.

(21) Appl. No.: 12/348,965

(22) Filed: Jan. 6, 2009

(65) Prior Publication Data

US 2010/0170479 A1 Jul. 8, 2010

(51) Int. Cl.
*F02M 37/04* (2006.01)
*F02B 75/06* (2006.01)

(52) U.S. Cl. ..... 123/509; 123/192.2

(58) Field of Classification Search ..... 123/192.1, 123/192.2, 508, 509
See application file for complete search history.

(56) References Cited

U.S. PATENT DOCUMENTS 4,290,395 A * 9/1981 Sakano et al. ..... 123/192.2
5,992,393 A 11/1999 Yoshida et al.
6,135,734 A 10/2000 Isozumi et al.
6,254,442 B1 * 7/2001 Suzuki ..... 440/38
6,471,008 B1 * 10/2002 Iwata ..... 184/106
6,971,361 B2 * 12/2005 Lawrence ..... 123/192.2
7,070,526 B2 * 7/2006 Lawrence ..... 474/87
7,631,629 B2 * 12/2009 Terada ..... 123/192.2
2003/0159680 A1 8/2003 Goodenough et al.
2004/0045537 A1 3/2004 Simon et al.
2004/0079316 A1 4/2004 Lawrence
2007/0227509 A1 * 10/2007 Ueda et al. ..... 123/509
2009/0241911 A1 * 10/2009 Fox et al. ..... 123/500
2009/0272366 A1 * 11/2009 Shafer et al. ..... 123/509

FOREIGN PATENT DOCUMENTS

JP 64000349 A 1/1989

* cited by examiner

*Primary Examiner*—Thomas N Moulis
(74) *Attorney, Agent, or Firm*—Jerome R. Drouillard; Julia Voutryas

(57) ABSTRACT

A combination dynamic balancer and fuel pump for an internal combustion engine includes a common housing having at least one balancer shaft and a fuel pump, with the fuel pump having the pumping element mounted directly within a working chamber formed within the housing for the balancer shaft and fuel pump. A pumping element may include a reciprocating or a rotary pumping element.

9 Claims, 4 Drawing Sheets

FUEL PUMP FOR INTERNAL COMBUSTION ENGINE

BACKGROUND OF THE INVENTION

1. Field of the Invention

The present invention is related to a mechanical fuel pump driven by, and incorporated within, a dynamic balancing mechanism in an internal combustion engine.

2. Disclosure Information

Automotive internal combustion engines once used carburetors for mixing air with fuel. Because carburetors utilize venturis to draw fuel into the air, carburetors were typically fed by low pressure fuel sources, such as mechanically or vacuum driven diaphragm pumps.

With the advent of electronic fuel injection, the ubiquitous solution for fuel pumps became the in-tank mounted electric pump. Such pumps are typically capable of reliably producing fuel pressures in the sub-100 p.s.i. regime.

Because of increasingly more stringent vehicle emission controls, engine developers have turned to direct injection of gasoline into the combustion chambers of the newest engines. Unfortunately, better mixture preparation requires that the desired injection pressures be much higher, and with these new fuel systems, electric pumps will likely be relegated to the role of a lift pump providing fuel to a higher pressure pump driven by the engine. Of course, it is desirable to provide such an added pump without unnecessary expense, and with a minimal requirement for additional space. Although it is known to mount pumps externally upon an engine, ever more crowded engine compartments do not readily lend themselves to this solution.

It would be desirable to provide an engine-driven mechanical fuel pump which has a minimum number of additional parts, coupled with high pressure capability, and which causes no added expenditure of precious space within the underhood environment of the vehicle.

SUMMARY OF THE INVENTION

A fuel pump for an internal combustion engine includes a housing containing both a balancer and a fuel pump, with the fuel pump including a working chamber contained within the housing. A fuel pump also includes at least one balance shaft mounted within the housing, with the balance shaft having at least one eccentric lobe for actuating a follower connected with a pump plunger mounted reciprocably within the working chamber. According to another aspect of the present invention, the balance shaft is driven rotationally by a crankshaft, preferably at twice the rotational speed of the crankshaft.

According to another aspect of the present invention, the fuel pump further includes at least one pressure control valve operatively connected with the working chamber and mounted within the housing, as well as a pulsation damper operatively connected within the working chamber and also mounted within the housing.

According to another aspect of the present invention, the housing of the fuel pump and balancer may be mounted adjacent a crankshaft of an engine.

According to another aspect of the present invention, the pumping element driven by the balance shaft may comprise in the alternative, a reciprocating pump, or a rotary pumping element such as a gerotor element, or a set of intermeshing gears.

It is an advantage of a combination dynamic balancer and fuel pump according to the present invention that the number of added parts needed to provide high pressure fuel pumping capability within an engine is reduced, as compared with prior art pumps, many of which are merely bolted to the outside of the engine in some fashion or another.

It is another advantage according to the present invention that the present fuel pump and balancer combination requires little, if any, additional space within the engine compartment of the vehicle.

It is another advantage of a combination balancer and high pressure fuel pump according to the present invention that very high fuel discharge pressures may be produced reliably due to the inherent strength of the integral working chamber and balancer housing.

Other advantages, as well as features of the present invention, will become apparent to the reader of this specification.

DETAILED DESCRIPTION OF THE PREFERRED EMBODIMENT

Figure 1:
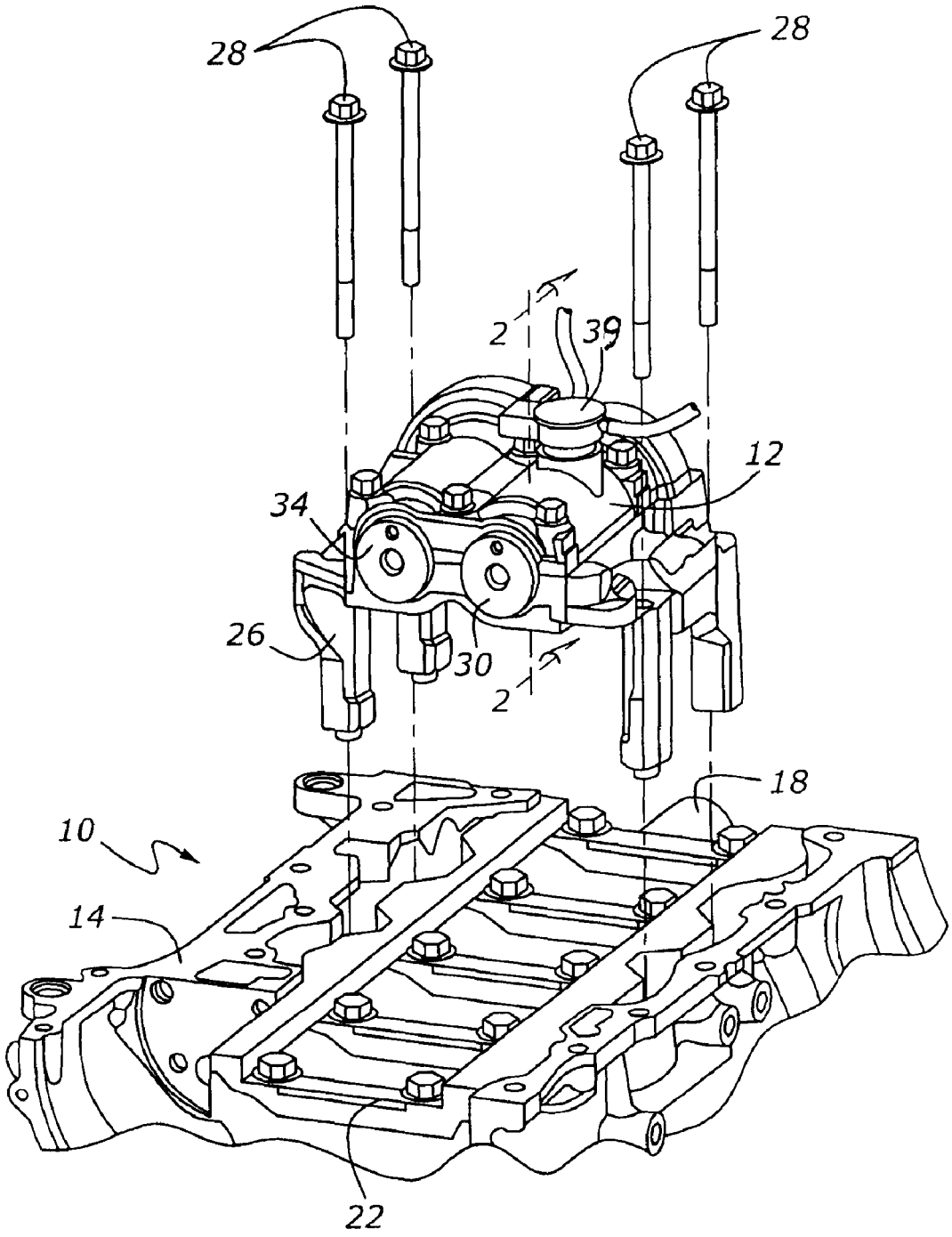
FIG. 1 is an exploded perspective view of a portion of an engine including a combination dynamic balancer and fuel pump according to an aspect of the present invention.

As shown in FIG. 1, engine 10 has a cylinder block, 14, and a number of main bearing caps, 22, securing crankshaft 18 within cylinder block 14. A balancer assembly includes a housing, 12, and two balancing shafts, 30 and 34. The balancer is said to be "dynamic" because it uses weighted, counter-rotating shafts to achieve the desired balancing. Housing 12 is mounted to cylinder block 14 by means of mounting brackets 26, and a number of fasteners, 28. Balance shafts 30 and 34 are coupled to crankshaft 18 by a gear train (not shown). When engine 10 is operating, crankshaft 18 rotates balancing shafts 30 and 34 at a high speed, preferably twice the rotational speed of crankshaft 18. In this manner, balance shafts 30 and 34 eliminate various imbalances associated with engine 12, such as a rocking couple and secondary shaking forces.

FIG. 1 also shows a pump section, 39, which is incorporated within housing 12. Pump section 39 is shown in detail in FIG. 2, and includes a cam follower, 42, which is driven by a cam lobe, 32, formed on balance shaft 30. Cam follower 42 is spring loaded by return spring 46, A piston, 44, reciprocates in bore 45 to move fuel through pump section 39. The pump housing, 38, for pump section 39 is one piece with housing 12. Pump section 39 further includes a parent bore, 50, which allows various pump parts such as cam follower 42, including piston 44, as well as a sleeve, 54, having a working chamber, 58, formed therein, to be loaded into pump section 39 from the uppermost portion of pump section 39. Because working chamber 58, which includes pump bore 45, is formed as an inner bore in sleeve 54, the diameter of chamber 58 may be selected to deliver the desired capacity of the fuel pump. Those skilled in the art will appreciate in view of this disclosure that the number of cam lobes 32 and, indeed, the height of each lobe, may also be selected to deliver the desired pump capacity.

Figure 2:
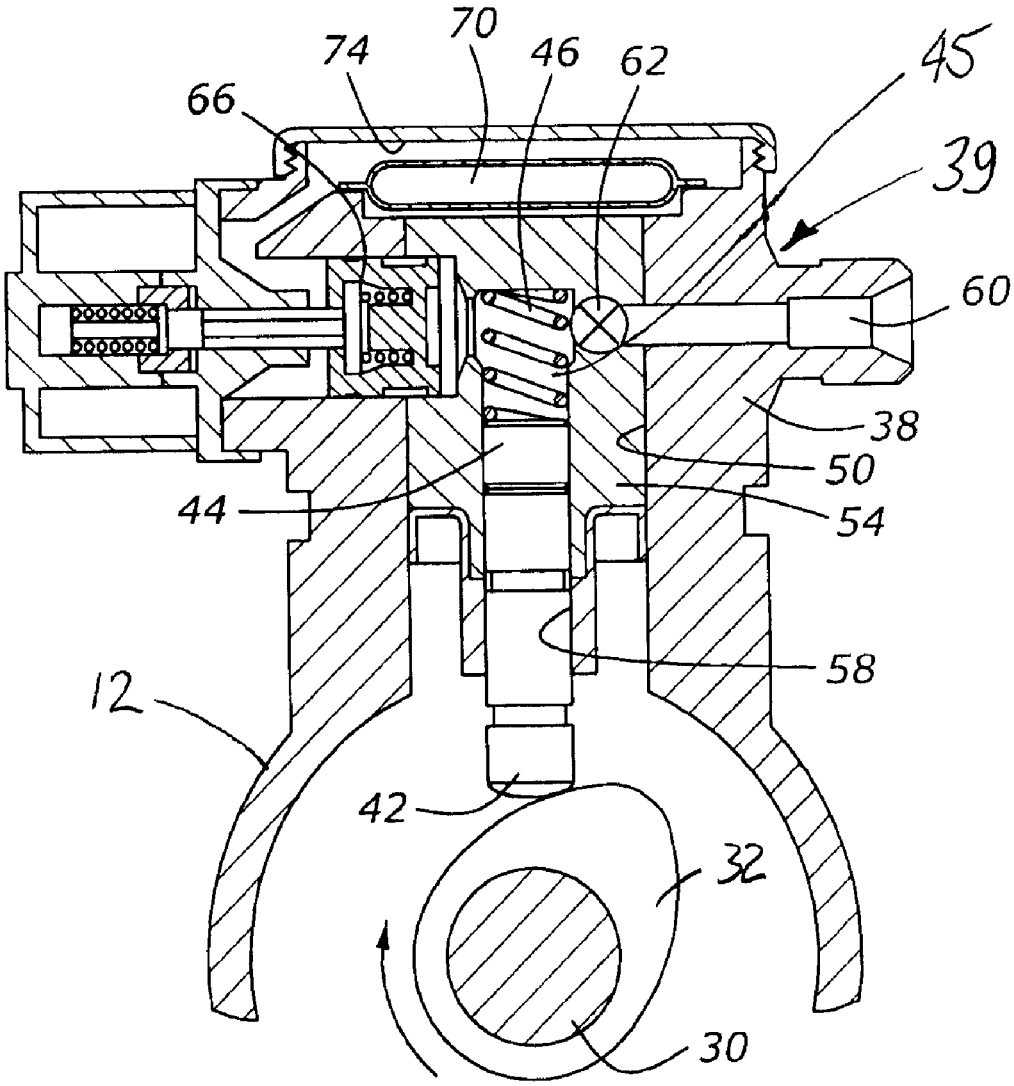
FIG. 2 is a sectional view of a first embodiment of a pump portion according to an aspect of the present invention, taken along line 2-2 of FIG. 1.

The fuel pump of FIG. 2 also includes a check valve, 62, for maintaining line pressure at outlet 60 when the engine 10 is shut down, as well as a pressure control valve, 66, and a pulsation damper, 70. Because pump section 39 has housing 38 which is one piece with housing 12, pump section 39 is very compact and structurally rigid. Structural integrity is important because it enables the capability for very high output pressures required with direct injection engines such as gasoline and diesel direct injection engines.

Figure 3:
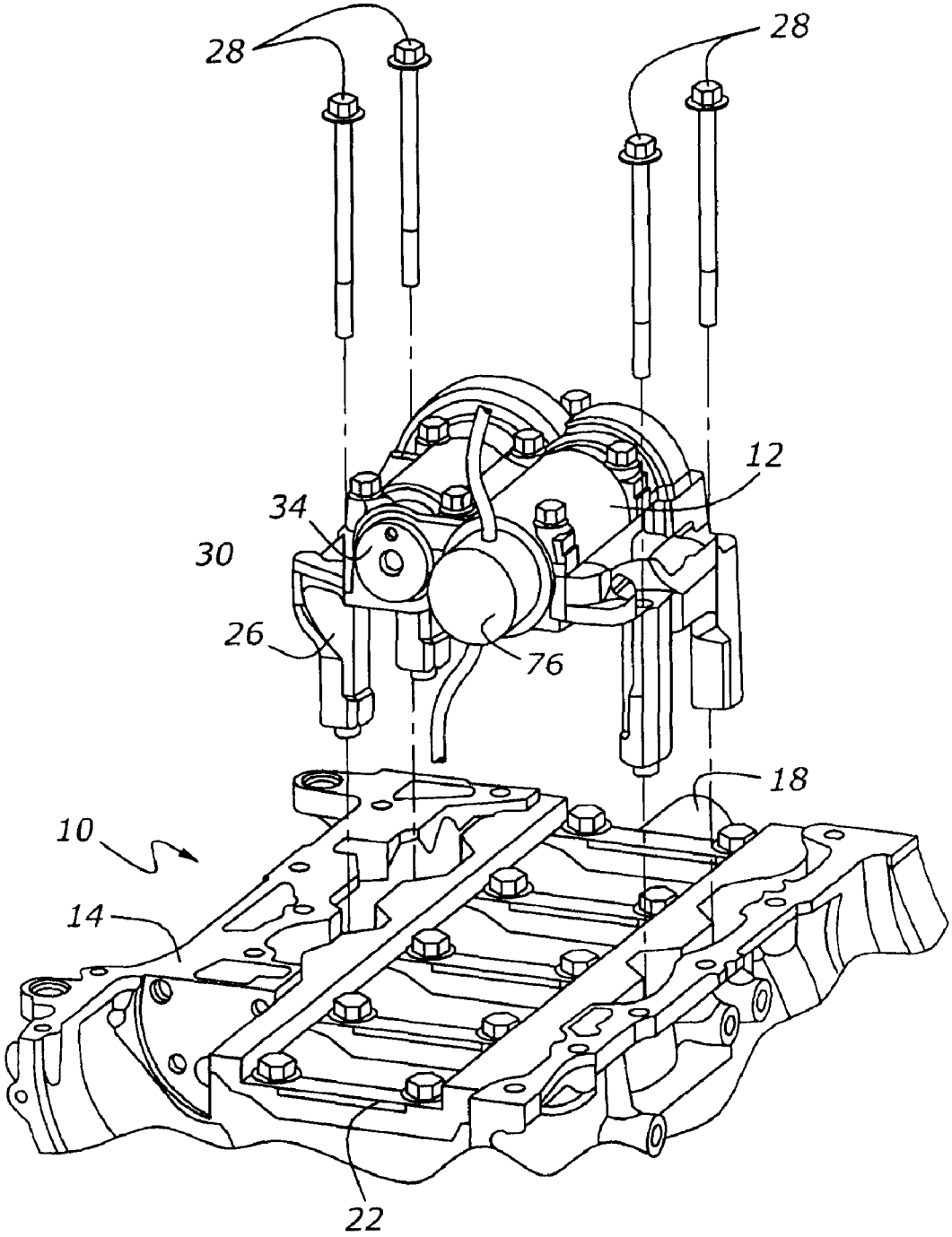
FIG. 3 is a perspective view of a portion of the balancer as shown in FIG. 1, but showing a rotary pump housing section, 76, incorporated within balancer housing 12.

FIG. 3 illustrates an embodiment in which a rotary pump housing section, 76, is incorporated into an end portion of housing 12.

Figure 4:
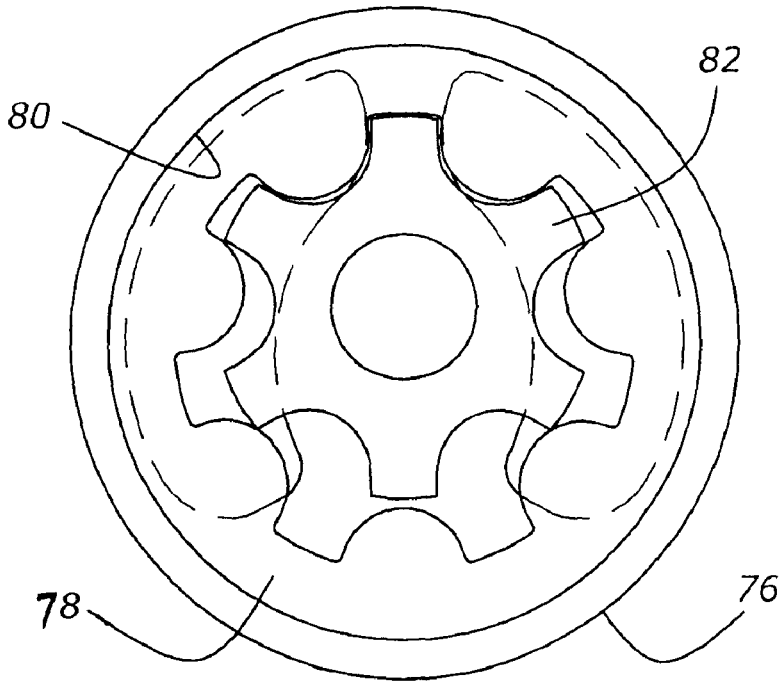
FIG. 4 illustrates a gerotor rotary pumping element according to an aspect of the present invention.

FIG. 4 illustrates a first type of rotary pumping element situated within working chamber 80 of rotary pump housing section 76. In the arrangement of FIG. 4, outer gerotor 78 and inner gerotor 82 mesh to provide high pressure pumped fuel when rotated by balance shaft 30. The coupling between the rotors and balance shaft 30 is not shown; those skilled in the art will appreciate in view of this disclosure, however, that a wide variety of common coupling devices could be employed, such as tang and slot or cross and yoke, or yet other devices known to those skilled in the art and suggested by this disclosure.

Figure 5:
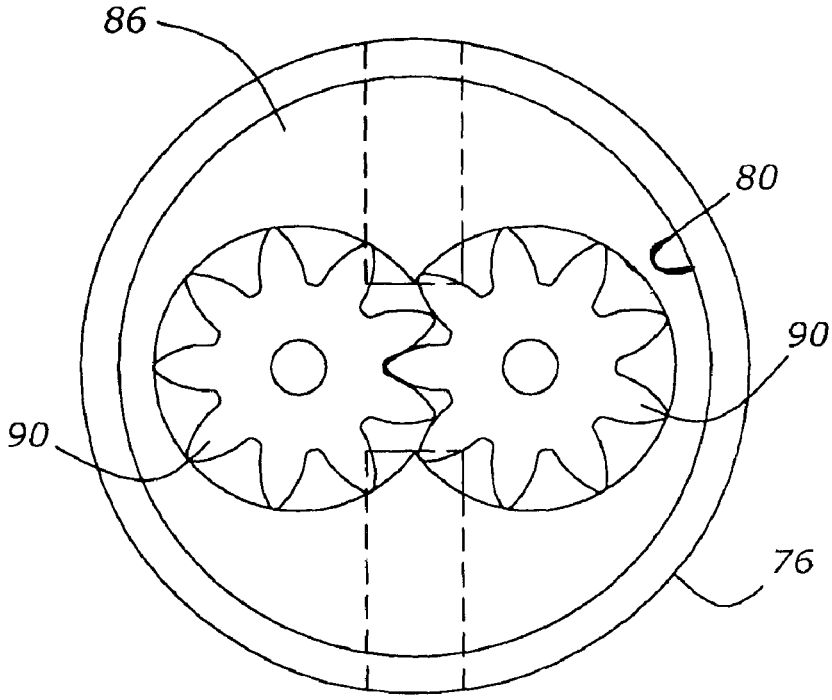
FIG. 5 illustrates a two-gear pump according to an aspect of the present invention.

FIG. 5 illustrates a second type of rotary pumping element, in this case a two gear pump in which gear housing 86 is mounted within working chamber 80 of rotary pump housing section 76. Two meshed gears, 90, provide the pumping action in a manner known to those skilled in the art and suggested by this disclosure.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A fuel pump for an internal combustion engine, comprising:

a one-piece housing containing both a dynamic engine balancer and a fuel pump, with said fuel pump comprising a working chamber contained within said housing, wherein said dynamic engine balancer comprises at least one balance shaft mounted within said housing, with said balance shaft having at least one eccentric lobe for actuating a follower connected with a pump plunger mounted reciprocably within said working chamber.

2. A fuel pump according to claim 1, wherein said balance shaft is driven rotationally by a crankshaft.

3. A fuel pump according to claim 2, wherein said balance shaft is driven by the crankshaft at twice the rotational speed of the crankshaft.

4. A fuel pump according to claim 1, further comprising at least one pressure control valve operatively connected with said working chamber and mounted within said housing.

5. A fuel pump according to claim 1, further comprising a pressure pulsation damper operatively connected with said working chamber and mounted within said housing.

6. A fuel pump according to claim 1, wherein said housing is mounted adjacent a crankshaft of an engine.

7. A combination dynamic balancer and fuel pump for an internal combustion engine, comprising:

a one-piece housing;

at least one balancer shaft mounted for rotation within said housing, with said balancer shaft being driven by a crankshaft;

a pump drive cam lobe formed on said balancer shaft; and a fuel pump comprising:

a pump plunger mounted within a bore formed in said housing; and a cam follower, mounted in said bore between said pump plunger and said pump drive cam lobe, for reciprocably actuating said pump plunger.

8. A combination dynamic balancer and fuel pump according to claim 7, further comprising at least one pressure control valve operatively connected with said bore and mounted within said housing.

9. A combination dynamic balancer and fuel pump according to claim 7, further comprising a pressure pulsation damper operatively connected with said bore and mounted within said housing.

* * * * *